US011393441B2

(12) United States Patent
Picciotto

(10) Patent No.: US 11,393,441 B2
(45) Date of Patent: Jul. 19, 2022

(54) DEVICE FOR SWITCHING ELECTRICAL OR ELECTRONIC SYSTEMS FOR PICKING UP THE VIBRATIONS OF THE STRINGS OF A MUSICAL INSTRUMENT

(71) Applicant: WILD CUSTOMS, Creuzier-le-Vieux (FR)

(72) Inventor: Laurent Picciotto, Creuzier-le-Vieux (FR)

(73) Assignee: WILD CUSTOMS, Creuzier-le-Vieux (FR)

( * ) Notice: Subject to any disclaimer, the term of this patent is extended or adjusted under 35 U.S.C. 154(b) by 528 days.

(21) Appl. No.: 16/341,564

(22) PCT Filed: Mar. 28, 2019

(86) PCT No.: PCT/FR2019/050717
§ 371 (c)(1),
(2) Date: Apr. 12, 2019

(87) PCT Pub. No.: WO2019/193268
PCT Pub. Date: Oct. 10, 2019

(65) Prior Publication Data

US 2021/0327398 A1 Oct. 21, 2021

(30) Foreign Application Priority Data

Apr. 3, 2018 (FR) ..... 18 52882

(51) Int. Cl.
*G10H 3/18* (2006.01)

(52) U.S. Cl.
CPC ..... *G10H 3/183* (2013.01); *G10H 3/181* (2013.01); *G10H 3/182* (2013.01)

(58) Field of Classification Search
CPC ..... G10H 3/183; G10H 3/181; G10H 3/182
(Continued)

(56) References Cited

U.S. PATENT DOCUMENTS 611,184 A * 9/1898 Rainey ..... A01C 7/18 111/41
2,207,341 A * 7/1940 Dickerson ..... G10H 3/183 984/370

(Continued)

FOREIGN PATENT DOCUMENTS

CN 100561573 C 11/2009
CN 106228962 A 12/2016

(Continued)

*Primary Examiner* — Christina M Schreiber
(74) *Attorney, Agent, or Firm* — Nixon & Vanderhye

(57) ABSTRACT

A device for switching electrical or electronical systems for picking up the vibrations of the strings of a musical instrument having a front face includes: a cradle to be fastened or integrated to the front face and provided with a unit for electrical connection to an amplification circuit; at least one barrel that is provided with at least two pickup systems, which is fitted to the cradle so as to be mobile in rotation with respect to the cradle between at least two positions so as to place, in each position, one pickup system in working position opposite the strings and that includes a unit for electrically coupling at least the pickup system opposite the strings to the connection unit; and a unit for rotating the barrel. The axis of rotation of the barrel is substantially parallel to the front face when the cradle is fastened to the latter.

13 Claims, 3 Drawing Sheets

(58) Field of Classification Search
USPC ..... 84/727
See application file for complete search history.

(56) References Cited

U.S. PATENT DOCUMENTS

| | | | | | |
|---|---|---|---|---|---|
| 2,976,755 | A * | 3/1961 | Fender | G10H 3/183 | 84/727 |
| 4,616,548 | A * | 10/1986 | Anderson | G10H 3/183 | 984/367 |
| 4,854,210 | A * | 8/1989 | Palazzolo | G10H 3/181 | 84/743 |
| 5,012,716 | A * | 5/1991 | Pagelli | G10H 3/182 | 84/727 |
| 5,252,777 | A * | 10/1993 | Allen | G10H 3/182 | 84/743 |
| 5,292,999 | A * | 3/1994 | Tumura | G10H 3/26 | 84/738 |
| 6,316,713 | B1 * | 11/2001 | Furst | G10H 1/26 | 84/728 |
| 7,015,390 | B1 * | 3/2006 | Rogers | G10H 1/32 | 84/723 |
| 10,311,851 | B1 * | 6/2019 | Stadnyk | G10H 3/183 | |
| 10,650,795 | B2 * | 5/2020 | Palmieri | G10H 3/143 | |
| 10,861,430 | B1 * | 12/2020 | Stanton | G10H 1/342 | |
| 11,074,898 | B1 * | 7/2021 | Boxberger | G10H 3/181 | |
| 2005/0120871 | A1 * | 6/2005 | Spalt | G10H 3/183 | 84/743 |
| 2006/0150806 | A1 * | 7/2006 | Hara | G10H 3/182 | 84/726 |
| 2008/0245217 | A1 * | 10/2008 | Stewart | G10H 3/181 | 84/727 |
| 2012/0312146 | A1 * | 12/2012 | Bekerman | G10H 3/183 | 84/726 |
| 2013/0276621 | A1 * | 10/2013 | Bekerman | G10H 3/181 | 84/723 |
| 2015/0000508 | A1 * | 1/2015 | Canavan | G10H 3/12 | 84/743 |
| 2015/0059560 | A1 * | 3/2015 | Perea Torres | G10H 1/32 | 84/726 |
| 2015/0294659 | A1 * | 10/2015 | Chapman | G10D 1/085 | 84/743 |
| 2017/0053631 | A1 * | 2/2017 | Strassell | G10H 3/181 | |
| 2021/0304720 | A1 * | 9/2021 | Bruen | G10H 3/181 | |
| 2021/0327398 | A1 * | 10/2021 | Picciotto | G10H 3/183 | |
| 2021/0407486 | A1 * | 12/2021 | Baker | G10H 3/146 | |

FOREIGN PATENT DOCUMENTS

| | | | | |
|---|---|---|---|---|
| CN | 110349560 | A * | 10/2019 | |
| FR | 2638882 | A1 | 5/1990 | |
| FR | 2664415 | A | 1/1992 | |
| FR | 2994760 | A | 2/2014 | |
| GB | 2324402 | A | 10/1998 | |
| JP | 57200096 | A | 12/1982 | |
| WO | 9011592 | A | 10/1990 | |
| WO | 9213335 | A | 8/1992 | |
| WO | 9841972 | A | 9/1998 | |
| WO | 99/39330 | A1 | 8/1999 | |
| WO | 9939332 | A | 8/1999 | |
| WO | WO-9939330 | A1 * | 8/1999 | G10H 3/182 |
| WO | 0036587 | A | 6/2000 | |
| WO | 2013153240 | A | 10/2013 | |

* cited by examiner

Fig.1
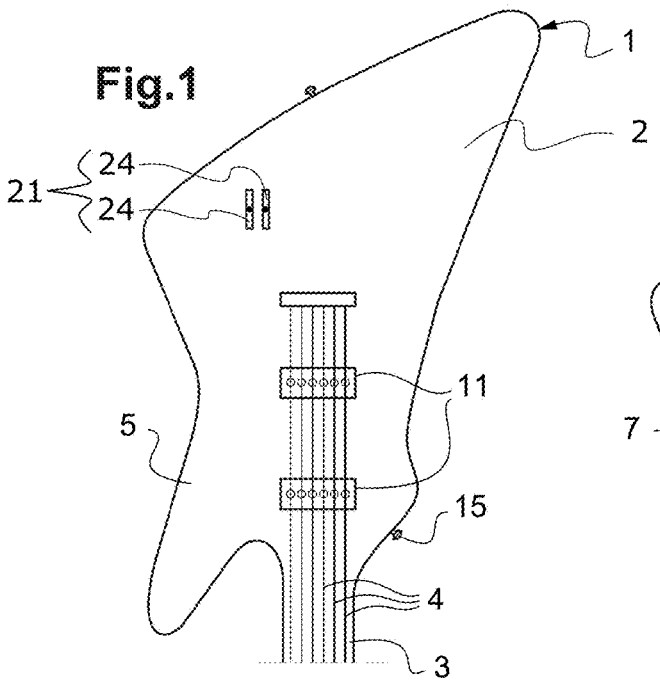
Fig.2
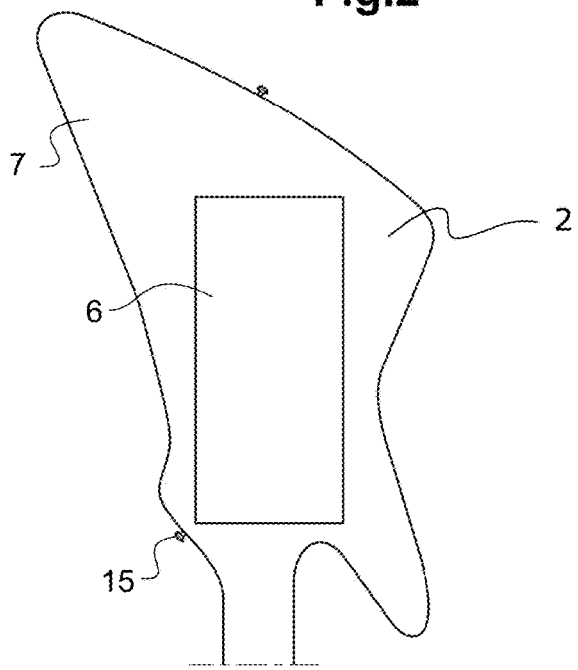
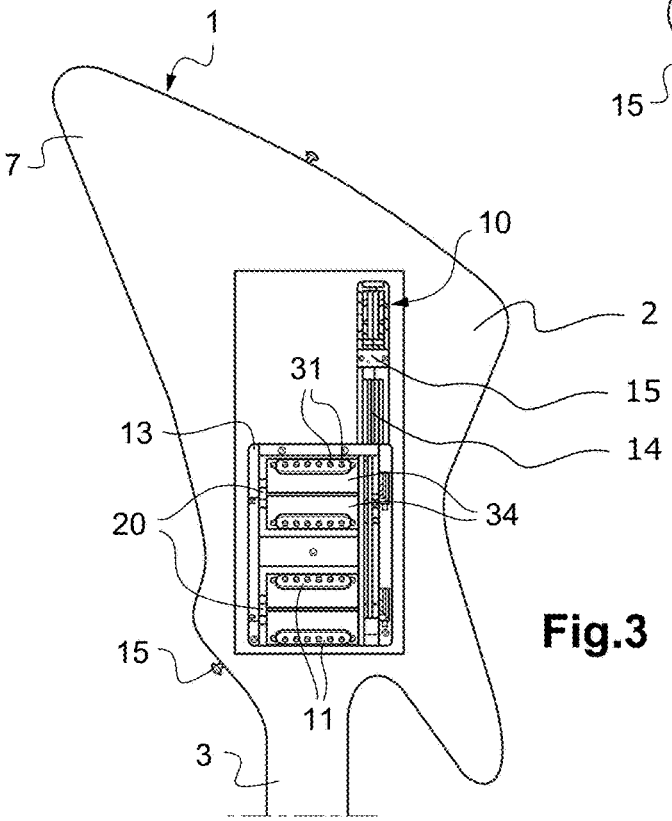
Fig.3

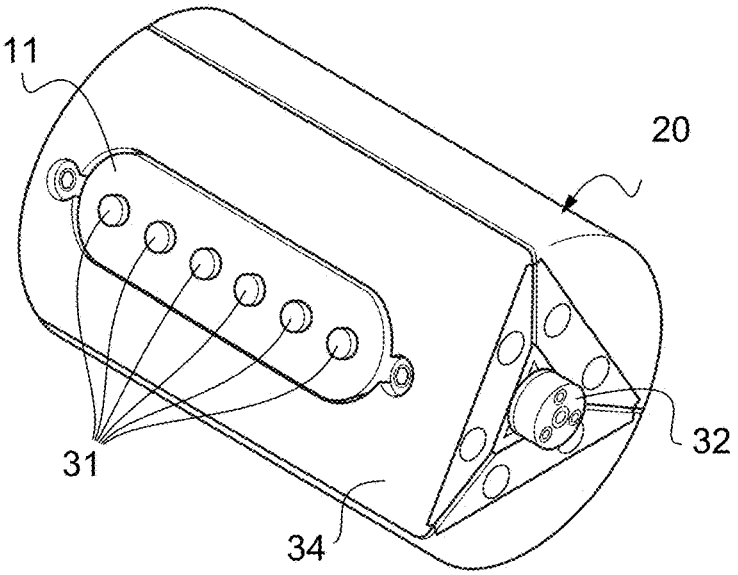
Fig.7
Fig.8
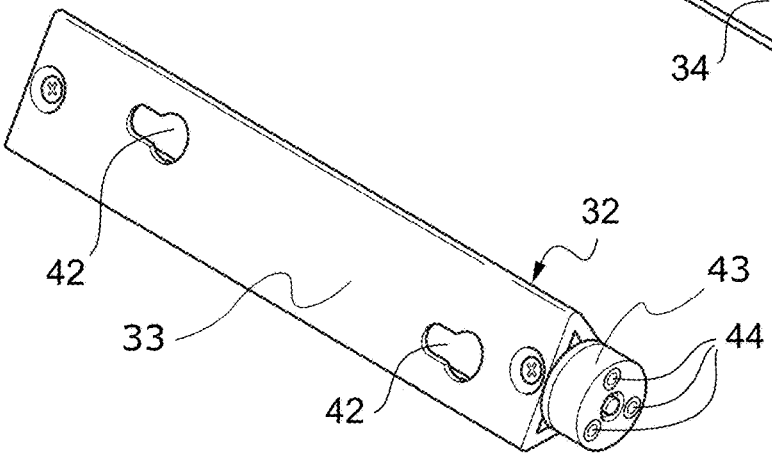
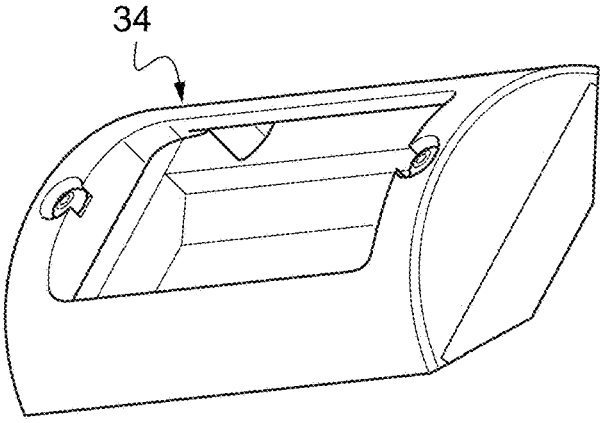
Fig.9
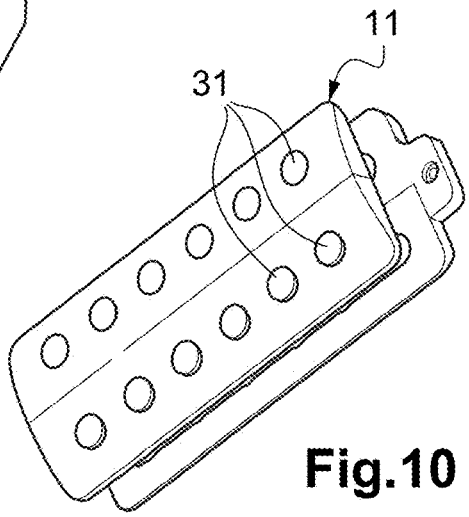
Fig.10

DEVICE FOR SWITCHING ELECTRICAL OR ELECTRONIC SYSTEMS FOR PICKING UP THE VIBRATIONS OF THE STRINGS OF A MUSICAL INSTRUMENT

BACKGROUND OF THE INVENTION

The present invention relates to the technical field of devices for switching electrical or electronical string vibration pickup systems, in particular in plucked or stringed instruments.

A document US 2015/0294659 discloses a device for switching electrical string vibration pickup systems, also called microphones, in an electric guitar. This device comprises a plate integrated to the front face of the guitar, on which are arranged four sets of microphones. This plate is mobile in rotation about an axis perpendicular to the front face of the guitar. The microphone sets are placed on the plate so that, when a microphone set is placed on the guitar bridge, a second microphone set is located on the guitar neck. Moreover, a microphone set has a direction of use relating to the thickness of each of the strings. There are hence two combinations in which the microphone sets are adapted to operate and two combinations in which the microphone sets are arranged in the opposite direction of use. These two other combinations are hence not suited for a proper operation. Hence, the musician has the choice between two combinations between which he/she can switch while he/she uses the guitar. Such a device, if it allows an easily change of microphone set, has for drawback to be voluminous, unsightly, and to occupy a significant surface of the front face, so that it substantially affects the vibratory behaviour of the latter, and hence the guitar tone as a whole.

BRIEF SUMMARY OF THE INVENTION

In order to remedy these drawbacks, the invention relates to a device for switching electrical or electronical systems for picking up the vibrations of the strings in a musical instrument comprising a front face facing the strings, the device comprising:

- a cradle intended to be fastened or integrated to the front face and provided with means for electrical connection to an amplification circuit,
- at least one barrel that is provided with at least two pickup systems, which is fitted to the cradle so as to be mobile in rotation with respect to the cradle between at least two positions so as to place, in each position, one pickup system in working position opposite the strings and that comprises means for electrically coupling at least the pickup system opposite the strings to the connection means, and
- means for rotating the barrel.

According to the invention, the device is characterized in that the axis of rotation of the barrel is substantially parallel to the front face when the cradle is fastened to the latter.

The direction of the barrel axis of rotation parallel to the plane of the front face allows limiting the footprint of the device according to the invention on the front face, so as for it to less affect the behaviour of the latter and to be more discrete than the device according to prior art. Moreover, the implementation of a barrel comprising electrical or electronical vibration pickup systems allows using a greater number of sets, while having a minimum bulk.

It is to be noted that the device according to the invention, and in particular the cradle thereof, can be integrated to the musical instrument during the manufacturing thereof.

Hence, the invention also relates to a musical instrument integrating at least one device for switching the pickup systems according to the invention.

According to one feature of the invention, the device comprises:

- at least two barrels, each barrel being provided with at least two pickup systems, and being fitted to the cradle so as to be mobile in rotation with respect to the cradle between at least two positions, so as to place, in each position, one pickup system in working position opposite the strings and comprising means for electrically coupling at least the pickup system opposite the strings to the connection means,
- means for rotating each barrel.

The use of at least two barrels allows picking up the vibrations at at least to different predetermined places, which can be performed with different systems, independent of each other. It results therefrom a wide choice of vibration pickup systems and a great number of possible combinations. Indeed, the two barrels are not linked to each other, so that they can be operated independently of each other.

According to another feature of the invention, each barrel is removably fitted to the cradle. The removable character allows a more easily change of the pickup system by changing the barrel. The system change is made very simply, without welding, without removing the strings, nor upsetting the instrument. It may be talked about a setting-free immediate-use system or "plug and play" system.

According to another feature of the invention, each barrel comprises at least one housing intended to receive a removable drawer carrying a pickup system. Hence, it is possible to easily change the pickup systems of a barrel, which allows the musician to easily choose the pickup systems available on a same barrel. Of course, the invention does not exclude that the pickup systems are mounted on the barrels in another manner than by means of drawers. Within the framework of the invention, the term "housing" must be understood in the broad sense and as a synonym of the term "location".

According to a variant of this feature of the invention, each pickup system is carried by a removable drawer and each barrel comprises as many housings as pickup systems. This alternative embodiment allows easily changing all the pickup systems of a same barrel and each of them independently from each other.

According to another feature of the invention, each pickup system comprises a row of transducers aligned along a direction D1 substantially parallel to the axis of rotation A1 of the barrel. Hence, when a pickup system is in working position, each transducer of this system is located opposite a string in order to pick up the vibration thereof.

It is to be noted that, according to the invention, the pickup systems can be commercial pickup systems and/or come from different manufacturers so that it is hence possible to have pickup systems having peculiar features and offering different tones.

According to still another feature of the invention, the device comprises means for rotationally indexing and immobilizing each barrel in each of the positions placing one pickup system in working position. These means allow halting the rotation of the barrel and securing it in a desired position. The desired position corresponding to the vibration pickup system, chosen by the musician, placed in working position. Moreover, the musician has the possibility to change the system when he/she plays.

According to another feature of the invention, the device comprises coupling means adapted so that only the pickup system in working position is electrically coupled to the connection means. Then, on one barrel, only one pickup system is active whereas the other are grounded, i.e. all their connections are electrically coupled to a same polarity of the amplification circuit or linked to the ground through a low resistance conductor. Hence, the signals of the pickup system in working position, collected by the amplification system, are not noisy. The active vibration pickup system, in working position, is then not affected by the other pickup systems present on the barrel.

According to another feature of the invention, the operation means of each barrel are motorized. Such a motorization facilitates the selection by the musician of the active pickup system that is active or in working position.

As indicated hereinabove, the invention also relates to a stringed instrument comprising a front face and at least one device according to the invention, fastened or integrated to the front face in such a manner that each pickup system in working position is located opposite the strings.

According to one feature of the invention, the instrument is an electric guitar.

The invention also relates to a drawer comprising at least one electrical or electronical system for picking up the vibrations of the strings in a musical instrument, wherein it is intended to be removably fitted to a barrel of a device according to the invention.

The invention also relates to a barrel provided with at least two electrical or electronical systems for picking up the vibrations of the strings in a musical instrument, wherein it is intended to be fitted to a device according to the invention.

Of course, the different features, variants and embodiments of the invention may be associated with each other according to various combinations, insofar as they are not incompatible or exclusive from each other.

BRIEF DESCRIPTION OF THE DRAWINGS

Moreover, various other features of the invention depart from the appended description made with reference to the drawings that illustrate a non-limitative embodiment of a device for switching electrical or electronical systems for picking up the vibrations of the strings in a musical instrument according to the invention.

FIG. 1 is an overall view of an electric guitar comprising a device according to the invention for switching the string vibration pickup systems, FIG. 2 shows a bottom view of an electric guitar according to the invention, FIG. 3 is a bottom view of an electric guitar whose device according to the invention is visible, FIGS. 7, 8, 9 and 10 are schematic partial perspective views showing in particular a barrel and the components thereof according to the invention.

Figure 4:
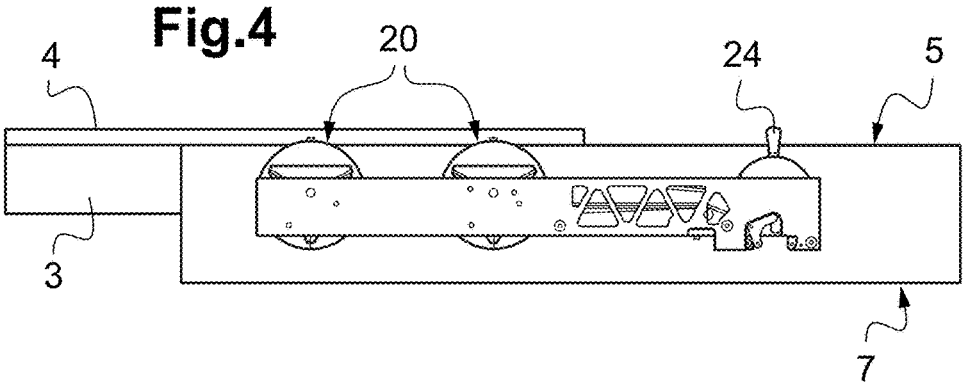
FIG. 4 is a sectional view of the device according to the invention, by transparency of the musical instrument.

It is to be noted that, on these figures, the structural and/or functional elements common to the different variants may have the same references.

DETAILED DESCRIPTION OF THE INVENTION

A musical instrument according to the invention, as illustrated in FIG. 1 and wholly denoted by the reference 1, comprises a body 2 with, in the present case, a neck 3 on which strings 4 located remote from and parallel to the front face 5 of the body 2 of the instrument 1 are held under tension. The front face 5 corresponds to the surface of the body 2 on which the strings 4 are anchored via, for example, a bridge fastened to the front face 5. The front face 5 may be the soundboard of the musical instrument 1. But the plucked or stringed musical instrument 1 according to the invention may have no soundboard, as it is the case for an instrument mainly composed of a body 2 carrying strings 4.

The invention aims to propose means for easily switching electrical or electronical systems for picking up the vibrations of the strings 4. For that purpose, the instrument is equipped with a device 10 for switching the systems 11 for picking up the vibrations of the strings 4.

Figure 6:
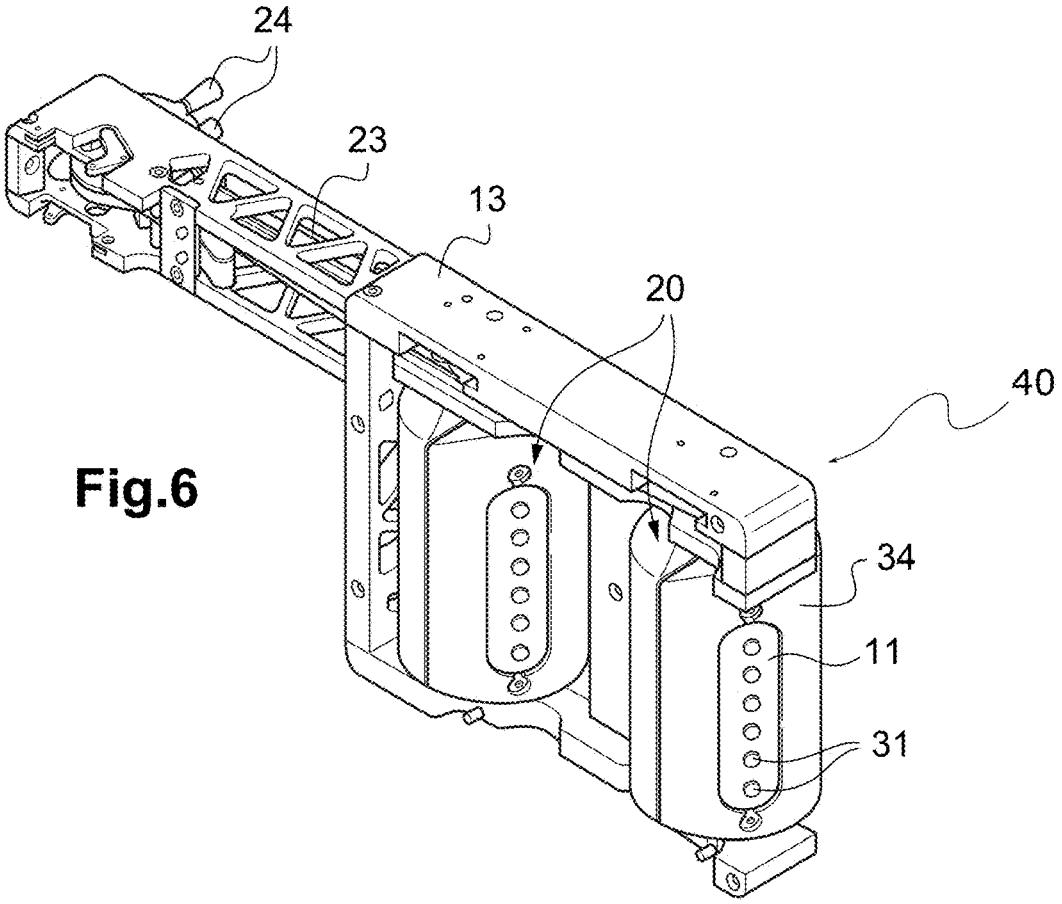
FIG. 6 is a schematic perspective view of the device according to the invention.

In FIG. 2, the musical instrument 1 comprises a trapdoor 6 on the rear face 7, opposite the front face 5, so as to position and connect the device 10 under the front face 5. As can be seen in FIG. 3, the device 10 comprises in particular a cradle 13 fastened or integrated to the front face 5 and provided with means 14 for electrical connection to an amplification circuit 15, only the outputs of which are shown. The cradle 13, according to the example illustrated, visible in particular in FIG. 6, is a metallic structure partially finely-worked, comprising two housings for receiving two barrels 20.

Figure 5:
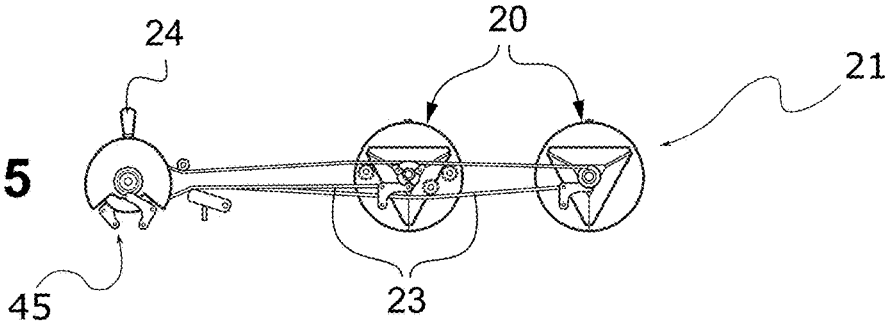
FIG. 5 is a view of the rotating mechanism of the device.

The illustrated example corresponds to a device 10 comprising two barrels 20 (described hereinafter) that respectively carry three pickup systems 11. The two barrels 20 are rotating about the axes A1 and A2, respectively, which are substantially parallel to each other and to the front face 5. According to one feature of the invention, the rotation of the barrels 20 allows bringing different vibration pickup systems 11 opposite the strings 4. For that purpose, the device 10 comprises means 21 for rotating the barrels 20. These rotating means 21 comprise a belt driving system 23 operated, on the one hand by two levers 24 for initiating and halting respectively the rotation of the barrels 20 and, on the other hand, by a motor integrated to the cradle 13. In FIG. 5, two respective driving belts 23 of the two barrels 20 are visible. The operation of a lever 24 causes the movement of a corresponding belt 23 that, used with pulleys, causes, through a gear system, the rotation of the barrel 20. The rotation of the barrel 20 about its axis A1 allows defining a working position, in which a single pickup system 11 among the systems 11 carried by this barrel 20 is located opposite said strings 4 of the musical instrument 1. The position of the chosen system 11, opposite the strings 4, defines the working position thereof.

The electrical or electronical systems 11 for picking up the vibrations of the strings 4 of a musical instrument 1 may be electric guitar microphones. According to the illustrated example, these systems 11 comprise transducers 31 arranged in a row along an axis substantially parallel to the axis of rotation of the barrel 20. The transducers 31 transform the vibration of the metallic strings 4 into an electrical signal. The transducers 31 may be composed of one or several magnets, surrounded by a copper wire coil. Each magnet generates a magnetic field. By vibrating, the strings 4, which are spun from a magnetic material, slightly vary the magnetic circuit, which induces an electromotive force in the coil, proportional to the speed of displacement of the string 4. The produced electrical signal is, for example, sent by wires to the amplification circuit 15. It has not been necessary to produce a sound to form it.

There exist different pickup systems 11, in particular those with a simple coil (that comprise a row of transducers 31)

and those with a dual coil (comprising two parallel rows of transducers 31). According to the illustrated example, in working position, the two barrels 20 carry simple-coil pickup systems 11. A dual-coil pickup system 11, visible in FIG. 10, is also adapted for a barrel 20 according to the invention.

FIG. 7 illustrates a barrel 20 according to an embodiment in which the barrel 20 carries three pickup systems 11. The barrel 20 is a rotary device having substantially a cylindrical shape, it comprises a central part 32, visible in FIG. 8. This part 32 has substantially the shape of a prism, it includes three housings 33 (herein for each face of the prism) adapted to each carry a respective drawer 34. FIG. 9 illustrates a drawer 34 according to the invention. And each drawer 34 is intended to accommodate a pickup system 11.

In the illustrated embodiment, the means 40 for electrically coupling the pickup systems 11 to the remainder of the electronics comprise a beryllium copper contactor system. The central part 32 comprises three housings 33 and each of the housings 33 comprises two substantially bulb-shaped orifices 42 that can accommodate a drawer 34. Hence, it is easy to clip a drawer 34 on a housing 33 and then to introduce therein one system 11 per drawer 34.

The central part 32 of the barrel 20 then carries the electrical coupling means 40 and hence form the link between the systems 11 and the connection means 14. One of the orifices 42 is adapted to link the pickup system 11 to the circuit, the other orifice 42 is adapted to link it to the ground. Each drawer 34 is immobilized on the central part 32 via the orifices 42 and in rest through its rear face on the central part 32. During the rotation of the barrel 20, there is no more physical contact between the copper contactors and the remainder of the electronics. The central part 32 is passed through by a cylindrical part 43 partially composed of copper, which forms the link to the ground. In FIGS. 7 and 8, the central part 32 of the barrel 20 comprise three outlets 44, towards the connection means 14, each corresponding to a pickup system 11. During the rotation, only the cylindrical part 43 is in contact with the connection means 14. Hence, no signal coming from the barrel 20 is transmitted to the remainder of the electronics. When the rotation is halted and a system 11 is in working position, the contactors are again opposite to each other and the signal is transmitted to the connection means 14.

The device further comprises means 45 for rotationally indexing and immobilization the barrel 20. According to the illustrated example, in particular in FIG. 5, these means 45 comprise two levers 24 that initiate the movement and halts the rotation of the barrel 20 in working position, according the system 11 chosen.

The embodiment described hereinabove is a non-limitative exemplary embodiment of the invention. Hence, a device 10 according to the invention may include more than two barrels 20 for picking up the vibrations of the strings 4 at more places. Likewise, a barrel of a device according to the invention may carry four pickup systems 11 or more, to offer a greater variety of systems 11. The cradle 13 may be designed differently, to be adapted to a new structure.

According to the exemplary embodiment described hereinabove, the means for operating the barrels comprise a belt system. However, other means 21 for rotating the barrels may be contemplated. For example, the barrel 20 may be rotated manually, i.e. the external surface of the barrel 20 then constitutes the means for operating the latter. The musician then operates the barrel 20 with one of his/her fingers by acting on the external surface and change that way the pickup system 11. And there exist other means 45 for rotationally indexing and immobilization the barrel 20. In this example, a latch system could halt the rotation of the barrel 20, wherein said latch does not resist to a certain pressure exerted manually. These means 45 may also comprise push buttons, wheels, rotary buttons, or any other means for choosing the pickup system 11 that will be placed in working position.

Other systems 11 for picking up the vibrations of the strings 4 may be contemplated. For example, optoelectronic systems comprising a laser diode for knowing the position of a string and the amplitude of the movement thereof. This information is transmitted and processed and converted into an amplifiable audio signal.

Of course, various other alternative embodiments may be contemplated within the framework of the appended claims.

The invention claimed is:

1. A device for switching electrical or electronic systems for picking up the vibrations of strings of a musical instrument including a front face facing the strings, the device comprising:

a cradle configured to be fastened or integrated to the front face, the cradle being provided with a plurality of pickup systems configured to electrically connect to an amplification circuit;

at least one barrel that is provided with at least two of the plurality of pickup systems, the at least one barrel being fitted to the cradle to be mobile in rotation with respect to the cradle between at least two positions to place, in each position, one of the pickup systems in a working position opposite the strings, at least the one pickup system that is opposite the strings being electrically connected to the amplification circuit; and a belt-driving system configured to rotate the at least one barrel, wherein the axis of rotation of the at least one barrel is substantially parallel to the front face when the cradle is fastened to the front face.

2. The device according to claim 1, wherein the at least one barrel comprises at least two barrels, each of the at least two barrels being provided with at least two of the pickup systems and being fitted to the cradle to be mobile in rotation with respect to the cradle between at least two positions, to place, in each of the positions, one of the pickup systems in the working position opposite the strings, at least the one pickup system that is opposite the strings being electrically connected to the amplification circuit, and the device further comprises a belt driving system configured to rotate each of the at least one barrel.

3. The device according to claim 1, wherein each of the at least one barrel is removably fitted to the cradle.

4. The device according to claim 1, wherein each of the at least one barrel comprises at least one housing configured to receive a removable drawer carrying one of the pickup systems.

5. The device according to claim 4, wherein each of the pickup systems is carried by a removable drawer, and each of the at least one barrel comprises a same number of housings as a number of the pickup systems.

6. A drawer configured to be removably fitted to the at least one barrel of the device according to claim 4, the drawer comprising:

at least one electrical or electronic system configured to pick up the vibrations of the strings of the musical instrument.

7. The device according to claim 1, wherein each of the pickup systems comprises a row of transducers aligned along a direction substantially parallel to the axis of rotation of the at least one barrel.

8. The device according to claim 1, further comprising a plurality of levers configured to rotationally index and immobilize each of the at least one barrel in each of the positions placing one of the pickup systems in the working position.

9. The device according to claim 1, wherein the belt-driving system of each of the at least one barrel is motorized.

10. A stringed instrument comprising:

a front face; and the at least one device according to claim 1 fastened or integrated to the front face such that each of the at least two pickup systems in the working position is located opposite the strings.

11. The stringed instrument according to claim 10, wherein the at least one device includes another device that is fastened or integrated to the front face such that each of the pickup systems in the working position is located opposite the strings, the other device comprising:

at least two barrels, each of the at least two barrels being provided with at least two pickup systems and being fitted to the cradle to be mobile in rotation with respect to the cradle between at least two positions to place, in each position, one of the pickup systems in a working position opposite the strings, at least the one pickup system opposite the strings being electrically connected to the amplification circuit, and a belt-driving system configured to rotate each of the at least two barrels.

12. The stringed instrument according to claim 10, wherein the instrument is an electric guitar.

13. A barrel configured to be fitted to the device according to claim 1, the barrel comprising:

at least two electrical or electronic systems configured to pick up the vibrations of the strings of the musical instrument.

* * * * *